US007195344B2

(12) United States Patent
Ansier et al.

(10) Patent No.: US 7,195,344 B2
(45) Date of Patent: Mar. 27, 2007

(54) APPARATUS AND METHOD FOR REFURBISHING USED CARTRIDGES FOR INK JET TYPE IMAGING DEVICES

(75) Inventors: Mark J. Ansier, Austin, TX (US); Frank Jemela, Katy, TX (US)

(73) Assignee: Tonerhead, Inc., McHenry, IL (US)

( * ) Notice: Subject to any disclaimer, the term of this patent is extended or adjusted under 35 U.S.C. 154(b) by 351 days.

(21) Appl. No.: 10/875,463

(22) Filed: Jun. 24, 2004

(65) Prior Publication Data

US 2004/0263588 A1 Dec. 30, 2004

Related U.S. Application Data

(60) Provisional application No. 60/540,613, filed on Jan. 30, 2004, provisional application No. 60/482,052, filed on Jun. 24, 2003.

(51) Int. Cl.
*B41J 2/175* (2006.01)

(52) U.S. Cl. ..... 347/85

(58) Field of Classification Search ..... 347/37, 347/49, 85; 141/2, 18
See application file for complete search history.

(56) References Cited

U.S. PATENT DOCUMENTS

| | | | | |
|---|---|---|---|---|
| 5,581,287 | A * | 12/1996 | Baezner et al. | 347/85 |
| 6,172,695 | B1 * | 1/2001 | Liu | 347/85 |
| 6,273,151 | B1 * | 8/2001 | Kong | 141/18 |
| 6,629,758 | B2 * | 10/2003 | Okamoto et al. | 347/85 |
| 6,971,740 | B2 * | 12/2005 | Yuen | 347/85 |

* cited by examiner

*Primary Examiner*—Anh T. N. Vo
(74) *Attorney, Agent, or Firm*—Vedder Price Kaufman & Kammholz

(57) ABSTRACT

A method and apparatus for refurbishing used ink jet cartridges. The apparatus utilizes an interchangeable cradle attachment arrangement that can hold virtually any type of ink jet cartridge. After the ink jet cartridge is placed in an ink jet cartridge cradle, a vacuum is applied to the print head of the cartridge to drain any excess ink. After draining excess ink, the ink jet cartridge can be replenished using the fill gun that is included in the ink jet cartridge refurbishing system.

10 Claims, 7 Drawing Sheets

APPARATUS AND METHOD FOR REFURBISHING USED CARTRIDGES FOR INK JET TYPE IMAGING DEVICES

CROSS-REFERENCE TO RELATED APPLICATION

This application is related to U.S. Provisional Patent Application Ser. No. 60/540,613 filed Jan. 30, 2004, and entitled, APPARATUS AND METHOD FOR REFURBISHING USED CARTRIDGES FOR INK JET TYPE IMAGING DEVICES and U.S. Provisional Patent Application Ser. No. 60/482,052 filed Jun. 24, 2003, and entitled APPARATUS AND METHOD FOR REFURBISHING USED CARTRIDGES FOR INK JET TYPE IMAGING DEVICES. The Applicants claim the benefit of these prior provisional applications under 35 U.S.C. §119(e). The entire content of these provisional applications is incorporated herein by this reference.

TECHNICAL FIELD OF THE INVENTION

The invention is directed to the refurbishment of ink jet cartridges used in ink jet type imaging devices such as printers, photocopiers, and facsimile machines, for example. The invention encompasses both devices and methods for refurbishing used ink jet cartridges.

BACKGROUND OF THE INVENTION

Ink jet imaging devices produce text and images on a substrate, such as paper, by ejecting minute quantities of ink from a reservoir onto the substrate in response to electrical commands. The electrical commands activate small orifices or ink jets in a print head to eject the ink in the desired locations to form the desired images. Because the ink in an ink jet imaging device is used up eventually in the printing process, conventional ink jet imaging devices include the ink reservoir in a replaceable cartridge commonly referred to as an ink jet cartridge. The print head containing the orifices through which the ink is ejected is also commonly included in the replaceable ink jet cartridge. The remainder of the ink jet imaging device includes electrical control components and mechanical components for moving the ink jet cartridge with respect to the printing substrate (paper) and for moving the substrate with respect to the ink jet cartridge.

Photocopiers, printers, plotters, and facsimile machines are examples of devices that may utilize an ink jet printing or imaging process. As used in this disclosure "ink jet device" encompasses any type of device using an ink jet process. Also, for purposes of the following description, the portion of the ink jet device other than the ink jet cartridge will be referred to herein simply as an ink jet device whether or not the ink jet cartridge is installed. The portion of the ink jet device that carries the consumable ink for the ink jet imaging process will be referred to as an ink jet cartridge, or simply cartridge, regardless of the particular design and regardless of the other components included on the ink jet device such as a print head and associated electrical lines and contacts.

FIG. 1 is a view in perspective of a typical prior art ink jet cartridge 100. Ink jet cartridge 100 includes a container 101 adapted to contain a supply of ink (the ink not being shown in the figure). The bulk of container 101 is generally rectangular in shape with a lower portion 102 projecting from the rest of the container. Print head assembly 104 is located on lower portion 102 of container 101 and includes a large number of minute, electrically stimulated orifices or ink jets 105 through which ink from container 101 is ejected in the printing process. It will be appreciated that the orifices or ink jets are shown diagrammatically in FIG. 1 in an exaggerated scale, and that the orifices are in fact very small in order to produce the desired image resolution. The commands or electrical stimuli required to operate the orifices or ink jets 105 are applied to print head assembly 104 through electrical conductors 106 which terminate at contact pads 107 on a side of container 101. An ink jet device in which cartridge 100 is to be used will include a corresponding set of electrical contacts exposed so as to make contact with contact pads 107 on the cartridge. The electrical signals required for operating print head assembly 104 originate from a print control system (not shown) included in the ink jet device. The illustrated prior art ink jet cartridge 100 also includes additional orifices facilitating fluid communication to ink container 101. The first additional orifice comprises an opening 109 commonly referred to as a vent opening or vent hole. The second additional orifice comprises an opening which is commonly referred to as a maze opening or maze hole located on the surface of cartridge 100 indicated by arrow 110. The maze hole is associated with a ball that functions as a check valve to prevent the flow of material out of container 101.

Due to space limitations and other physical restrictions in ink jet devices, ink jet cartridges typically have a relatively limited supply of ink for use in the ink jet printing process. The working life of the print head assembly of an ink jet cartridge is, in fact, commonly much greater than the working life of the ink supply in the cartridge. Thus, although original equipment manufacturers may prefer for ink jet device users to use totally new ink jet cartridges due to the relatively high profit margins associated with selling new ink jet cartridges, it is commonly possible to refurbish and reuse ink jet cartridges many times before they are no longer serviceable. Due to the popularity and low cost of ink jet devices, the sale of both new and used ink jet print cartridges has become a very big business.

SUMMARY OF THE INVENTION

The present invention includes a method and apparatus for refurbishing used ink jet cartridges. The apparatus of the invention utilizes an interchangeable cradle attachment arrangement that can hold virtually any type of ink jet cartridge. After the ink jet cartridge is placed in an ink jet cartridge cradle, a vacuum is applied to the print head of the cartridge to drain any excess ink. After draining excess ink, the ink jet cartridge can be replenished using the fill gun that is included in the ink jet cartridge refurbishing system.

The cradle attachment arrangement of the ink jet cartridge refurbishing system includes a first component that is secured to a supporting surface and has a receiving slot that is open on the top receiving end and closed on the bottom end by a support member. The second component of the cradle attachment arrangement includes a flange that is substantially the same shape as the receiving slot of the first component. The second component is connected to an ink jet cartridge cradle that holds the ink jet cartridge selected to be refurbished. The flange from the second component can be positioned alternatively in an attached position inside the receiving slot and a detached position outside of the receiving slot. Each ink jet cartridge cradle may include a vacuum sealing element that connects to a vacuum line. The vacuum applied through the vacuum line is used to help draw any remaining ink out of the ink jet cartridge while the cradle is positioned with the flange in the attached position.

The cradle attachment arrangement may be used at one or more stations included in the ink jet cartridge refurbishing system for servicing ink jet cartridges. For example, the system may include an ink recovery station that serves only to draw ink out of the used ink jet cartridges using a vacuum source as described above. In addition, the system may include a clean/fill station. Either of these types of stations may employ a cradle attachment arrangement as described above.

The clean/fill station utilizes a specialized ink jet cartridge cradle that includes a fixed component and a sliding component that moves vertically to allow loading and unloading an ink jet cartridge. The sliding component includes a maze vacuum sealing element associated with the cartridge maze hole and the fixed component includes a print head sealing element associated with the cartridge print head and an ink fill sealing element associated with an ink fill tube. The vacuum sealing element and print head cartridge sealing element are each connected to a vacuum source through respective tubes. The vacuum applied at the maze hole closes the valve in the cartridge at that location during the operation of the clean/fill station and the vacuum applied at the print head assembly draws ink through the ink fill tube and into the reservoir to re-fill the cartridge with ink.

An additional component of the present invention is an ink pump assembly that includes an ink intake, ink outlet, and a control input. The ink pump assembly sends ink through an ink supply line to a fill gun that uses a fill needle that may be positioned to direct ink into an empty ink jet cartridge. The fill gun also includes a handle that is connected to the fill needle. A fill trigger switch or start switch is also preferably located on the handle. The fill trigger switch applies a control signal to the control input that causes the pump motor to activate the pump assembly and begin sending ink to the fill gun. Ink flows to the fill gun and into the ink jet cartridge through the properly positioned fill needle until a timer removes the control signal from the control input after a specified period of operation has elapsed. The flow of ink can also be stopped by a kill switch located on the fill gun that, when activated, produces a signal that is applied to turn off the ink pump. Once the ink jet cartridge has been re-filled with ink, air bubbles that may have formed in the ink may be removed from the cartridge by applying a vacuum at the vacuum sealing element of the recovery station.

The ink pump assembly can be mounted in the interior of a housing that is also included in the ink jet cartridge refurbishing system of the present invention. The housing may also provide a supporting surface for one or more cradle attachment arrangements described above and for a fill gun holster that holds the fill gun when not in use. The fill gun holster also may serve to collect any excess ink flowing from the fill needle when the fill gun is in a holstered position.

These and other objects, advantages, and features of the invention will be apparent from the following description of the preferred embodiments, considered along with the accompanying drawings.

DESCRIPTION OF PREFERRED EMBODIMENTS

Figure 2:
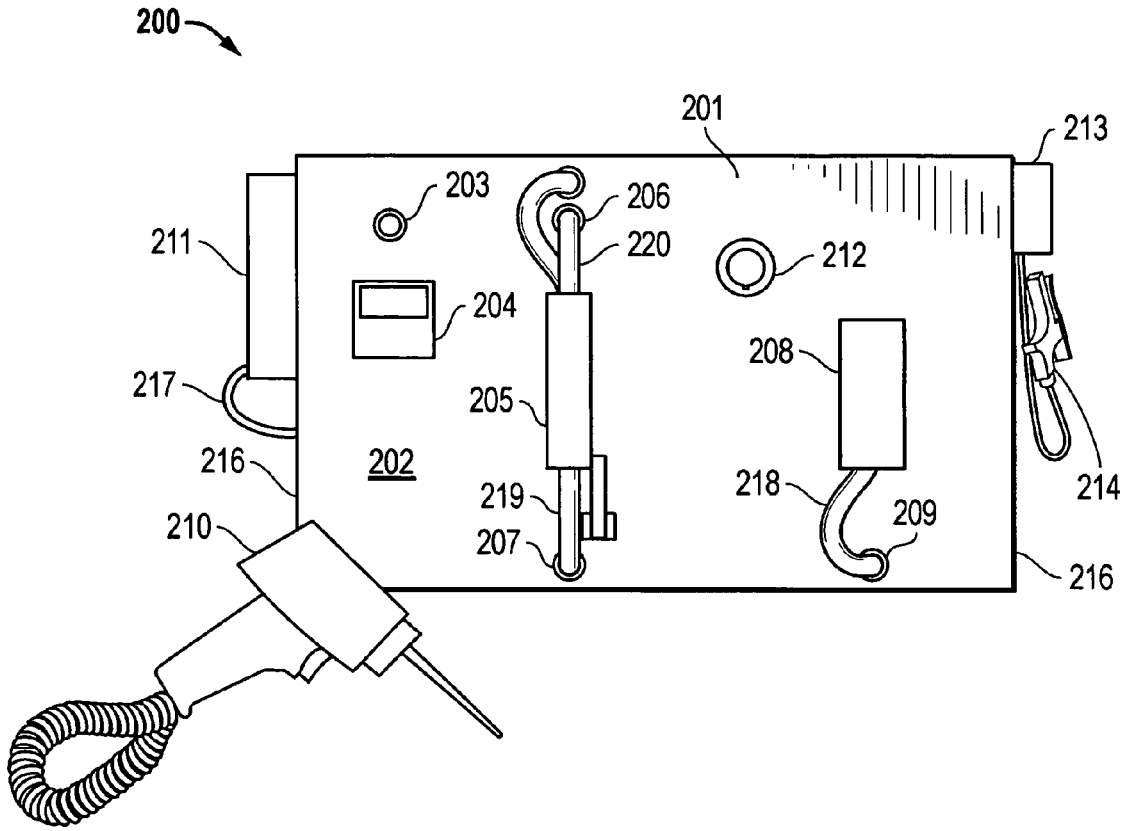
FIG. 2 is a partially diagrammatic front view of an ink jet cartridge refurbishing system embodying the principles of the present invention.
Figure 3:
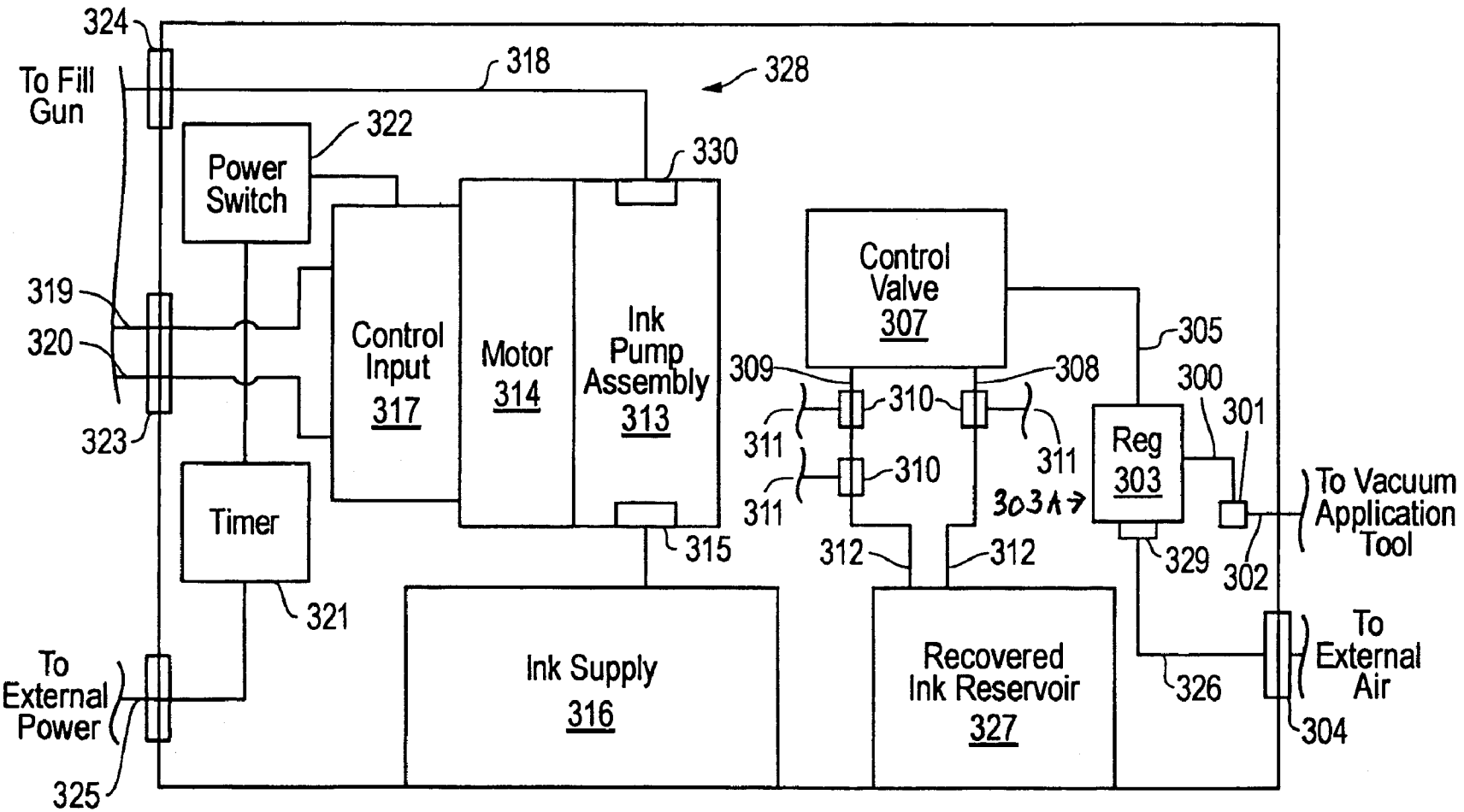
FIG. 3 is a diagrammatic representation of the ink jet cartridge refurbishing system shown in FIG. 2.

FIGS. 2 and 3 illustrate an ink jet cartridge refurbishing system 200 embodying the principles of the invention, while FIGS. 4 through 13 illustrate various components of the system. Referring first to the overall system view in FIG. 2, ink jet cartridge refurbishing system 200 embodying the principles of the invention generally includes a housing shown at reference numeral 201. A lateral side 216 of housing 201 provides a support surface for a receptacle or fill gun holster 211 used to hold an ink jet cartridge filling gun or fill gun 210. The opposite lateral side 216 of housing 201 provides a location for pressure regulator 213 and a vacuum application tool 214. Pressure regulator 213 regulates air pressure to the various components of the system 200 that require air pressure for operation. In the alternative, pressure regulator 213 may be located in the interior of housing 201 as described in more detail with respect to FIG. 3.

Front panel 202 of housing 201 includes two different stations for performing refurbishing operations on ink jet cartridges. The illustrated form of the invention includes a cradle attachment arrangement shown at reference numeral 208, which can function as a recovery station for a variety of ink jet cartridges or a pressure equalization station, and a separate clean/fill station shown at reference numeral 205. Each of these stations operate using at least one vacuum connection. The required vacuum is supplied from a respective vacuum fitting 206, 207, or 209 in front panel 202 through a respective vacuum hose 218, 219, or 220. As will be discussed below with reference to FIG. 5, clean/fill station 205 uses two separate connections and an ink supply connection. The required vacuum is created in each instance with a venturi effect device as will be discussed further below with reference to FIG. 3 although any suitable vacuum source may be used within the scope of the invention. While multiple external vacuum sources may be may be utilized, in a preferred embodiment a single source of external air is directed to regulator 303 which in turn creates a vacuum using a venturi effect as described herein resulting in first vacuum source 303A. Regulator 303 then directs the vacuum through conduit 305 to control valve 307 which in turn provides a second vacuum source 219A and third vacuum source 220A through outlet tubes 308 and 309 to vacuum tubes 311. Vacuum tubes 311 extend to a respective one of the vacuum fittings 206, 207 or 209 mounted on front panel 202 which in turn are connected to vacuum supplied tubes 219 and 220 as described in front in ¶38.

Interchangeable cradle attachment arrangement 208 and fill gun 210 included in system 200, allow the system to refurbish substantially any type of ink jet cartridge. The specific refurbishment process varies from one cartridge to another, however, the system is designed to accommodate each process step. In some cartridges, it is necessary or desirable to completely remove any ink remaining in the cartridge or the remnants of any cleaning material that may have been injected in the cartridge. Ink or other liquid remnant removal may be accomplished in a cartridge by using cradle attachment arrangement 208 as a recovery station adapted for the particular cartridge. The cartridge is inserted into a cradle associated with cradle attachment arrangement 208 and then a vacuum is applied to withdraw the desired fluid from the cartridge. Other types of cartridges require a vacuum to be applied at a particular top opening in order to equalize the pressure in the cartridge and allow it to function properly. This pressure equalization may be accomplished using a pressure equalization cradle with cradle attachment arrangement 208. Still other types of cartridges may be cleaned and filled in a single step in system 200 using clean/fill station 205 as will be described below.

In order to allow system 200 to refurbish substantially any type of ink jet cartridge, the system includes a second type of ink jet cartridge filling arrangement in addition to the clean/fill station 205 mounted on front panel 202. This second type of ink jet cartridge filling arrangement includes fill gun 210 connected to a supply of ink located within housing 201 and described in more detail and illustrated with respect to FIG. 3. It should be noted that fill gun 210 is preferably connected to a supply of black ink, but may be connected to a supply of any color ink to allow for the refurbishment of color ink jet cartridges. Fill gun holster 211 mounted on lateral side 216 is preferably tilted downwardly and includes an overflow conduit 217 connected at its lowermost end to collect any overflow ink and direct it to the recovered ink reservoir. As will be described in detail below with reference to FIGS. 3 and 13, fill gun 210 is adapted to measure a desired amount of ink into an ink jet cartridge to refill the depleted ink jet cartridge.

Front panel 202 includes a number of switch actuators for controlling a switch mounted in housing 201 behind front panel 202. Vacuum control actuator 212 controls the position of the vacuum control switches. These switches will all be illustrated and described in connection with FIG. 3. Also visible in FIG. 2 is fill gun switch actuator 203 and timer actuator 204 for controlling operation of fill gun 210.

FIG. 3 provides a diagrammatic representation of the various internal components of ink jet cartridge refurbishing system 200 including the internal components associated with fill gun 210 and the internal components associated with stations 205 and 208 mounted on front panel 202. All of the vacuum operated portion of system 200 may be described with reference to mainly the right half of FIG. 3 and the fill gun related components are shown to the left side of the figure.

Referring first to the vacuum operated portion of system 200 in the right half of FIG. 3, air supplied from an external source fitting 304 through conduit or hose 326 is used to produce the required vacuum by venturi effect in the illustrated preferred form of the invention. This external source may be a large volume source (first vacuum source 303(*a*)) that is capable of providing sufficient volume at the desired pressure to simultaneously operate substantially all of the air pressure driven components in system 200. Hose 326 preferably terminates in an appropriate fitting 329 associated with pressure regulator 303, which also transmits vacuum from first vacuum source 303(*a*).

Pressure regulator 303 regulates the supplied air at the desired constant pressure for operating the various vacuum generating venturi devices described below. Various conduits distribute the regulated pressurized air to the venturi devices, known as vacuum ejectors, and any control valves associated with those devices. One conduit 300 runs to a vacuum ejector 301. The vacuum tube 302 extending from vacuum ejector 301 provides a vacuum for vacuum application tool 214. Another conduit 305 is provided for the stations in system 200 requiring a vacuum source. The distal end of conduit 305 is connected to control valve 307 which is operated by vacuum control actuator 212 mounted on front panel 202 as shown especially in FIG. 2. Control valve 307 is adapted to alternatively block the flow of air to its respective two outlet tubes 308 and 309 or to direct air to either one of the associated outlets. No control valve is shown as being associated with conduit 300 for supplying air to operate vacuum application tool 214, however, other forms of the invention may include a suitable valve for enabling or disabling vacuum application tool 214.

Each outlet tube 308 and 309 is associated with a respective vacuum ejector 310. Each vacuum ejector creates a vacuum at vacuum tubes 311 as the pressurized air flows straight through the ejector from the respective outlet tube to a respective exhaust tube 312. Thus, when control valve 307 is switched to allow air to flow through a particular outlet tube 308 or 309, the air passing through the main path of the respective vacuum ejector 310 creates the desired vacuum. Each vacuum tube 311 extends to a respective one of the vacuum fittings 206, 207, or 209 mounted on front panel 202 (shown in FIG. 2). Each exhaust tube 312 extends to the recovered ink reservoir 327 included in system 200.

Referring now to the left side of FIG. 3, control unit 328 is provided for fill gun 210 shown in FIG. 2. Control unit 328 includes an ink pump assembly 313 driven by a motor 314 through a control input 317. Pump 313 receives ink from ink supply 316 at ink intake 315, and directs ink through ink outlet 330 to ink supply line 318 that terminates in a suitable fitting 324 on an external surface of housing 201. In the illustrated form of the invention fitting 324 is mounted on the same lateral side 216 of housing 201 as fill gun 210 (shown in FIG. 2). Control input 317 for pump motor 314 includes a number of electrical control lines that extend to switches mounted on fill gun 210 as will be described further below with reference to FIG. 13. FIG. 3 shows a separate control line 319 for a kill switch and another control line 320 for a fill gun start switch. In the preferred form of the invention, the electrical control lines extend from control input 317 to a suitable fitting 323 on an external surface of housing 201. A suitable electrical control line connects to fitting 323 and extends to fill gun 210 as will be described below with reference to FIG. 13. FIG. 3 also shows that control input 317 is associated with timer 321 and power switch 322, which is connected to an external power supply through external power supply connector 325 for driving pump motor 314. As will be described further below, timer 321 is used to control pump 313 to supply a desired volume of ink to fill an ink jet cartridge being refurbished.

Figure 4:
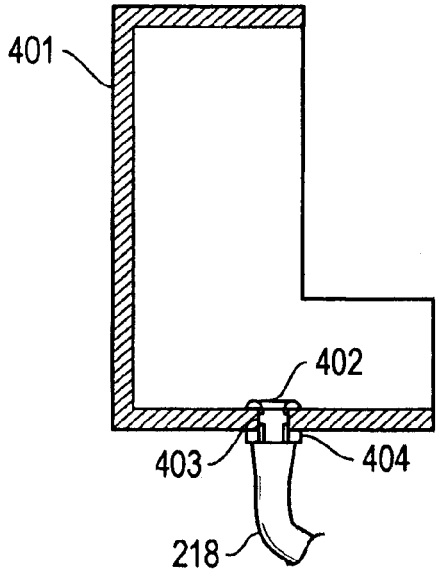
FIG. 4 is a view in longitudinal section of a recovery cradle used in the system shown in FIG. 2.

FIG. 4 shows a recovery station at cradle attachment arrangement 208 included on front panel 202 of refurbishing system 200. In this illustrated embodiment of cradle attachment arrangement 208, the recovery station includes a fitting or receiver referred to as an ink jet cartridge cradle, or simply cradle, 401 that is adapted to receive a particular type or style of ink jet cartridge. Cradle 401 snugly receives the particular type of ink jet cartridge (not shown in FIG. 4) with a desired component on the cartridge, normally the print head, aligning with a vacuum sealing element 402 on an inner surface of the cradle 401. Vacuum sealing element 402 is associated with an opening 403 in the cradle and a fitting 404 to which a connecting vacuum hose 218 (also shown in FIG. 2) may be connected. It will be appreciated that each cradle is specifically adapted for a particular type of ink jet cartridge. It should also be noted that when vacuum sealing element 402 is adapted to seal against a print head, the sealing element preferably overlaps with a peripheral portion of the plate commonly associated with a print head so that the vacuum is not allowed to pull the print head plate from its position on the ink jet cartridge.

Figure 1:
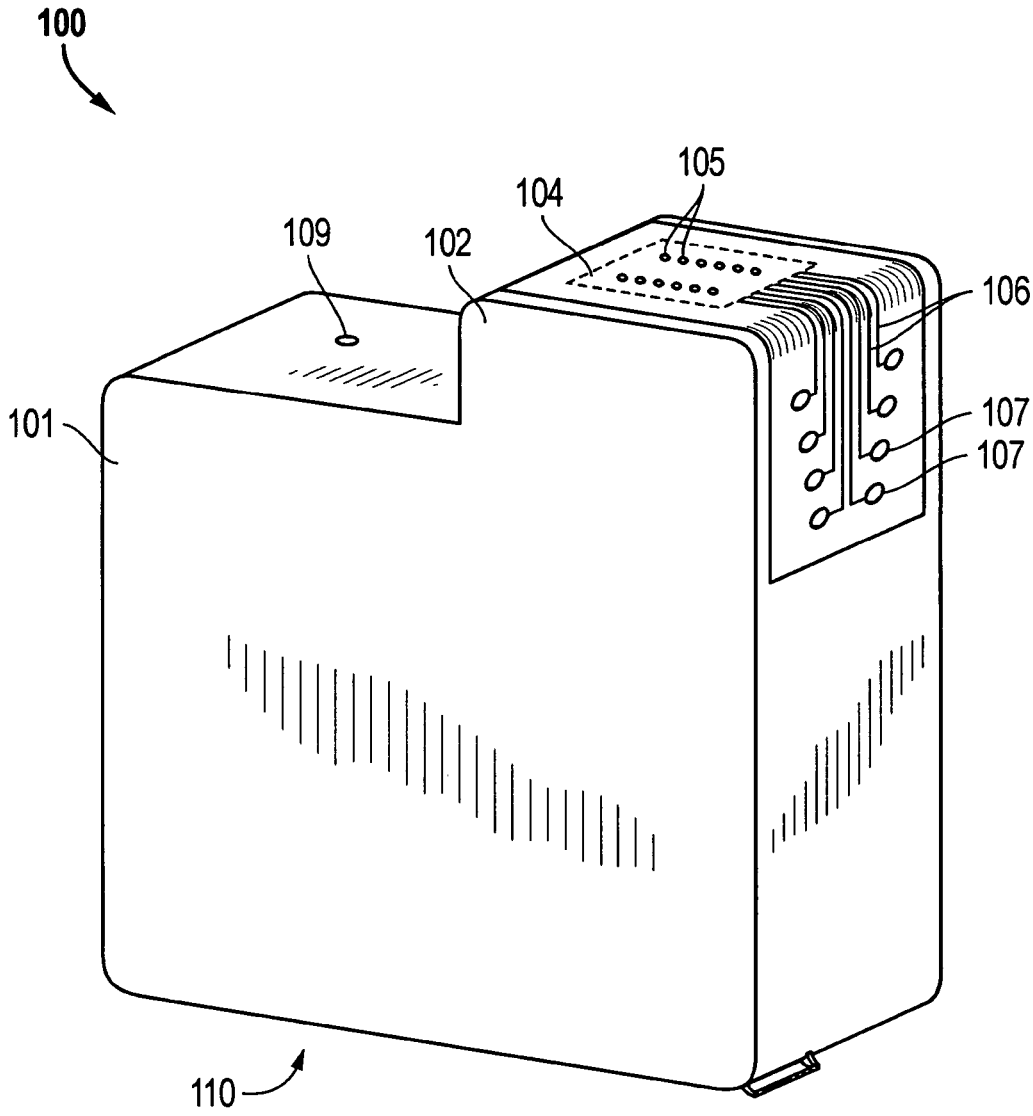
FIG. 1 (Prior Art)
FIG. 1 is a view in perspective of a prior art ink jet cartridge of a type that may be refurbished according to the present invention.
Figure 5:
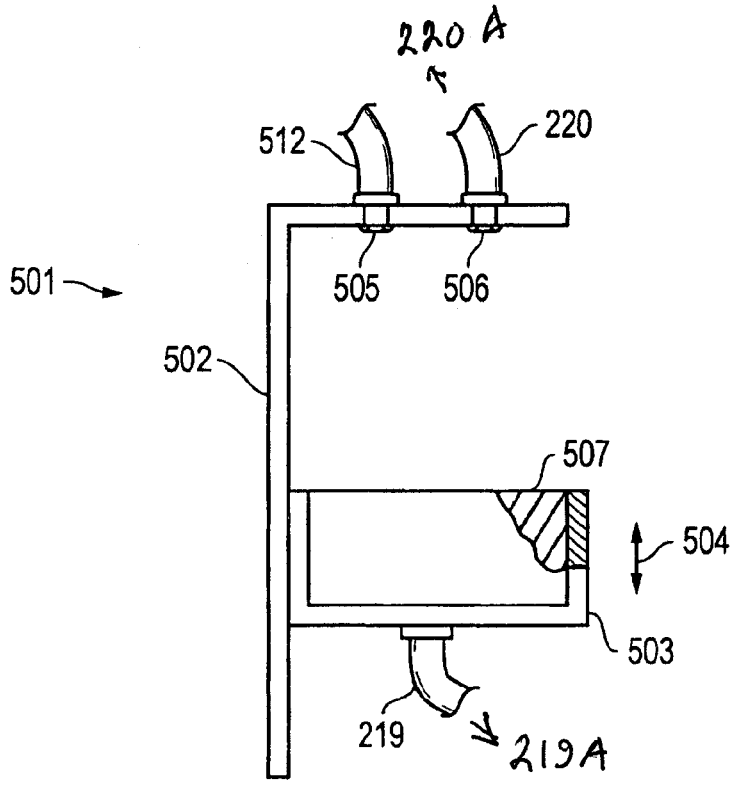
FIG. 5 is a partially cut away side view of an ink jet cartridge clean and fill cradle used in the refurbishing system shown in FIG. 2.

FIG. 5 shows ink jet cartridge clean and fill cradle or clean/fill cradle 501 associated with the clean/fill station 205 shown in FIG. 2. This particular station is adapted to clean and fill a popular type of ink jet cartridge using a particular cleaning and filling technique. Clean/fill cradle 501 includes a fixed component 502 and a sliding component 503. Sliding component 503 is adapted to slide up and down with respect to fixed component 502 as indicted by arrow 504. In an upper position, sliding component 503 presses an ink jet cartridge (not shown) received in clean/fill cradle 501 against an upper part of fixed component 502 to provide seals against two upper sealing elements 505 and 506. A seal is also produced in a resilient material 507 lining the upper surface of sliding component 503. A vacuum is required at two different points in clean/fill cradle 501. Thus, it will be noticed in FIG. 3 that control valve 307 directs air through the two separate vacuum ejectors 310 associated with outlet tube 309. The vacuum from one ejector is applied through tube 219 to sliding component 503 of clean/fill cradle 501 through tube 220. Clean/Fill cradle 501 is also connected to an ink full tube 512 which ultimately extends to ink supply 316 (shown in FIG. 3). In the particular type of ink jet cartridge with which clean/fill cradle 501 is adapted to be used, the used cartridge is placed in the cradle so that ink fill tube 512 and ink fill sealing element 505 align with a vent opening (109 in FIG. 1), the upper vacuum supply tube 220 and cartridge print head sealing element 506 align with the print head (104 in FIG. 1) of the cartridge, and the lower vacuum supply line 219 applies a vacuum to the maze opening (110 in FIG. 1) of the cartridge. Each is supplied with vacuum by respective second vacuum source 220A and third vacuum source 219A, which, in a preferred embodiment originate from first vacuum source 303A which divides the vacuum into second vacuum source 219A and third vacuum source 220A. The vacuum applied to maze opening 110 ensures that the valve associated with the maze opening stays closed while the vacuum applied through print head 104.

Figure 6:
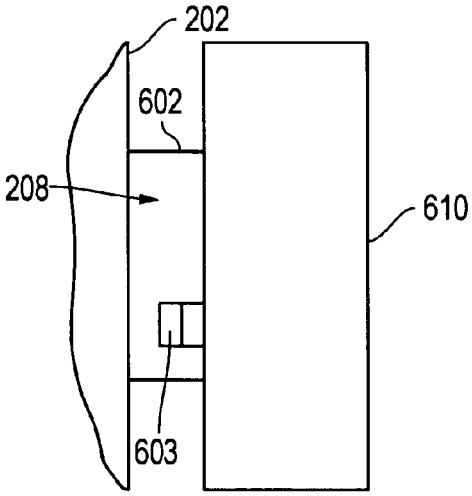
FIG. 6 is a side view showing a preferred cradle attachment arrangement that may be used for one or more cradles in the refurbishing system shown in FIG. 2.

Referring now to FIG. 6, the preferred cradle attachment arrangement 208 allows the respective cradle to be removed and replaced with a different cradle as necessary to accommodate different types of ink jet cartridges. The preferred cradle attachment arrangement 208 includes a receiving feature or first component 602 which is adapted to be attached to front panel 202 at a suitable location. First component 602 is shown particularly in FIGS. 7 through 9. An attachment feature or second component 603 of cradle attachment arrangement 208 is adapted to be connected to a back surface of the respective cradle 610 and cooperates with first component 602 to produce a secure but easily releasable attachment between cradle 610 and front panel 202. This second component 603 is illustrated particularly in FIGS. 10 and 11. In an alternative embodiment, the positions of the two components of cradle attachment arrangement 208 are reversed, so that the receiving feature is connected to the back surface of cradle 610 and the attachment feature is secured to front panel 202.

Figure 8:
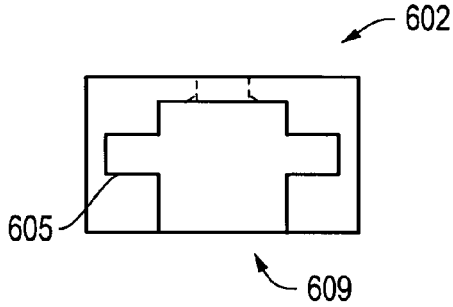
FIG. 8 is a top view of the first component of the cradle attachment arrangement.
Figure 7:
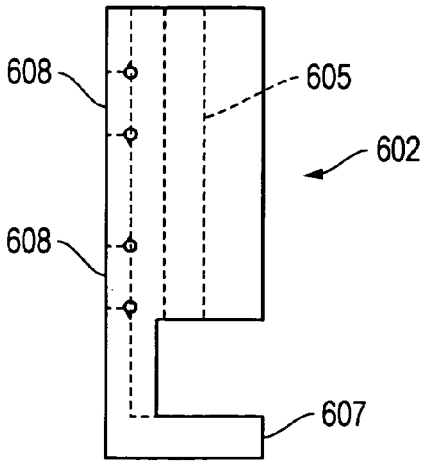
FIG. 7 is a side view of a first component of the cradle attachment arrangement.
Figure 9:
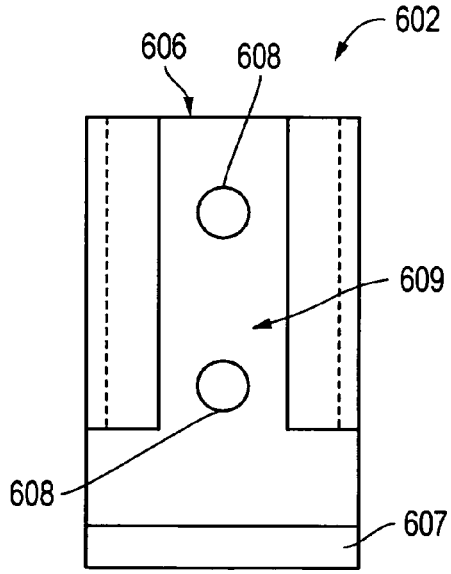
FIG. 9 is a front view of the first component of the cradle attachment arrangement.

As shown in FIGS. 7 through 9, first component 602 of cradle attachment arrangement 208 includes a block of material having a receiving slot 605 (shown in FIG. 8) formed therein. Receiving slot 605 includes a top opening 606 and terminates at the opposite end of first component 602 with a support member 607. It will be noted particularly from the top view of FIG. 8 that receiving slot 605 includes generally a T-shaped cross-section. FIG. 9 shows that the base of the T-shape comprises a front opening 609. Although any suitable connector may be used, in the preferred form of the invention first component 602 is connected to front panel 202 with bolts and thus includes bolt holes 608 through which the connecting bolts may extend.

Figure 10:
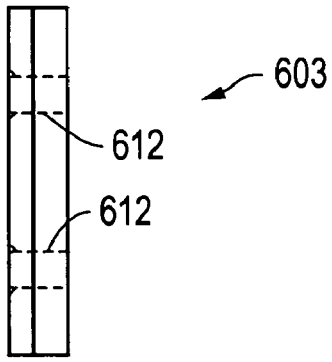
FIG. 10 is a side view of a second component of the cradle attachment arrangement.
Figure 11:
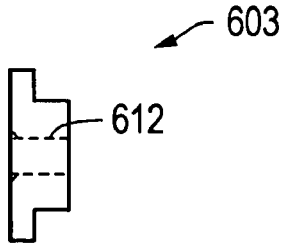
FIG. 11 is a top view of the second component of the cradle attachment arrangement.

Referring now to FIGS. 10 and 11, second component 603 of cradle attachment arrangement 208 includes an elongated member having a generally T-shaped transverse shape as shown best in FIG. 11. This T-shape corresponds generally to the transverse shape of receiving slot 605 as shown in FIG. 8. Second component 603 is adapted to be bolted to cradle 610 (shown in FIG. 6) and thus also includes bolt holes 612, although the invention is not limited by the manner in which second component 603 is connected to the cradle. In fact, the cradle and second component may be integrally formed.

Figure 12:
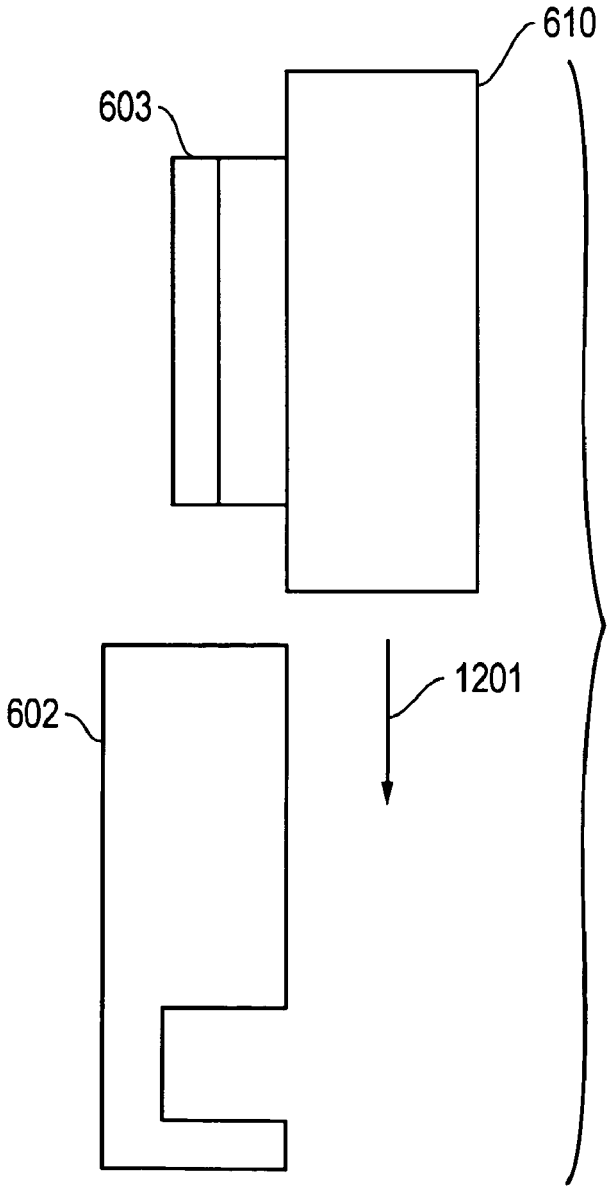
FIG. 12 is an exploded side view of the ink jet cartridge cradle and cradle attachment arrangement shown in FIG. 6.

FIG. 12 shows first component 602 secured in an appropriate position on front panel 202 and second component 603 secured to the back surface of cradle 610. The cradle may be secured to panel 202 by first positioning cradle 610 and attached second component 603 above first component 602 as shown in FIG. 12. From this point, the cradle and second component 603 may be moved along a line indicated by arrow 1201. Eventually the T-shaped second component 603 slides into the correspondingly shaped slot 605 (shown in FIG. 8) until the components reach the position shown in FIG. 6. In this first or attached position, cradle 610 is securely attached to front panel 202 and may receive an ink jet cartridge for a desired refurbishment operation. However, cradle 610 may be removed easily to a second or detached position by simply sliding it upwardly in a direction opposite to that indicated by arrow 1201 until the T-shaped second component 603 clears slot 605. Another different cradle with the same type of second component connected thereto may then be slid into first component 602 to accept a different type of ink jet cartridge as necessary.

Figure 13:
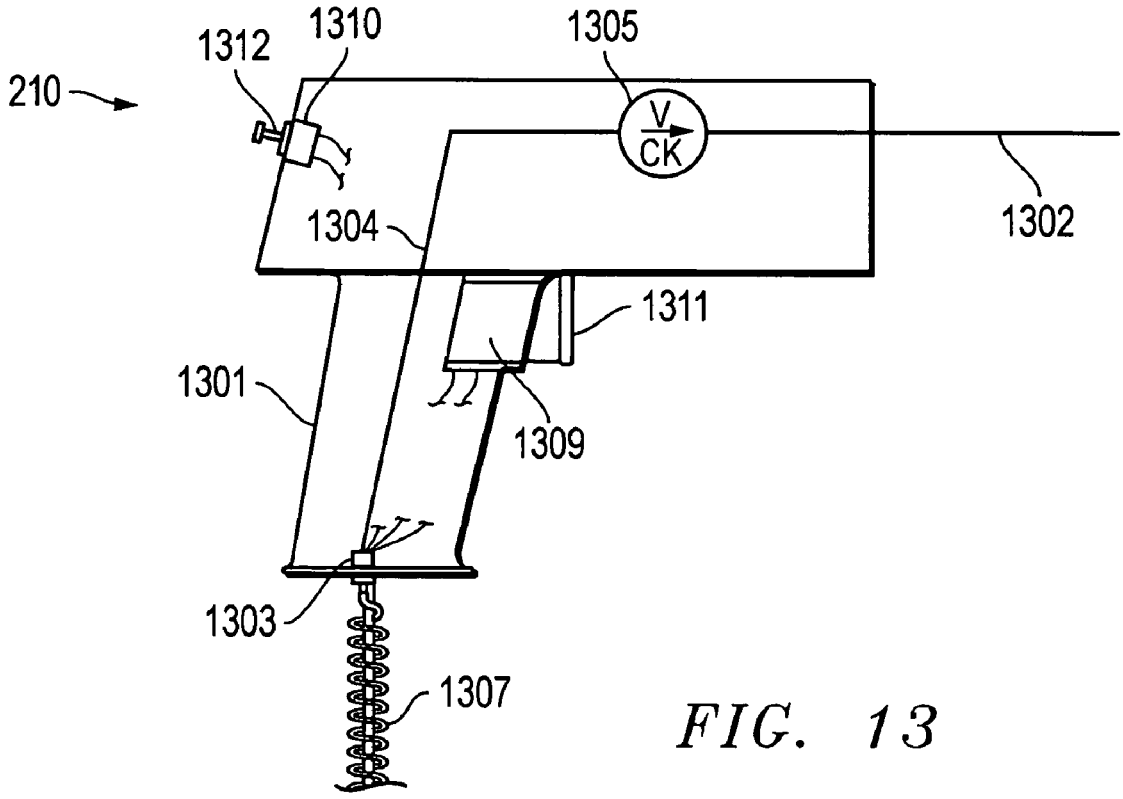
FIG. 13 is a mostly diagrammatic representation of the ink jet cartridge fill gun included in the ink jet cartridge refurbishing system shown in FIG. 2.

FIG. 13 shows a somewhat diagrammatic representation of fill gun 210 described above in FIG. 2. Fill gun 210 includes a handle or pistol-type grip 1301 and a fill needle 1302. The fill gun also includes a fitting 1303 for making a connection with an ink supply line/electrical control line 1307. An ink conduit 1304 extends from fitting 1303 to a proximal end of fill needle 1302. Preferably a suitable check valve 1305 is included in conduit 1304 to prevent ink from flowing back in the direction from the fill gun to ink supply line/control line 1307. Fill gun 210 also includes two switches, a start switch or fill trigger switch 1309 and a kill switch 1310. Fill trigger switch 1309 is activated through a trigger actuator 1311, while kill switch 1310 is activated through a separate button actuator 1312.

The operation of fill gun 210 may now be described with reference to FIGS. 13 and 3. In order to fill an empty ink jet cartridge with fill gun 210, the user first withdraws fill gun 210 from fill gun holster 211 on system 200 and inserts the distal end of the needle 1302 into an orifice on the particular ink jet cartridge. The user also sets timer 321 associated with fill gun 210 to run pump 313 for a particular amount of time. Since pump 313 runs at a known speed and moves a known volume of ink in any given time, setting timer 321 has the effect of setting the volume of ink to be supplied to the cartridge. Once timer 321 is set and fill needle 1302 is appropriately placed in the empty cartridge, the user depresses trigger actuator 1311 to trip the fill trigger switch 1309. Control input 317 associated with pump 313 uses the control signal generated at fill trigger switch 1309 to start motor 314 and cause pump 313 to start dispensing ink through needle 1302. Motor 314 continues to run until timer 321 runs down to zero at which point the timer signals control input 317 to stop the motor and thus the flow of ink into the cartridge.

At any point in the process the user may depress kill switch actuator 1312 to provide a control signal to control input 317 to stop the motor before receiving a control signal from the timer. The user may wish to do this for example when the needle proves to be incorrectly placed in the ink jet cartridge and ink does not flow into the cartridge as desired. In a final step, a vacuum may be applied to the print head of a newly refurbished ink jet cartridge to remove any air bubbles from the cartridge that may disrupt the flow of ink while the cartridge is in use. This vacuum may be applied through a suitable cradle connected to the housing 201 through a cradle attachment arrangement as described above.

Although the illustrated form of the invention includes a timer for measuring the volume of ink supplied to fill the ink jet cartridge, other forms of the invention may use different arrangements for metering the volume of ink into a cartridge. For example, the volume of ink supplied to refill a cartridge may be preferably measured directly from a peristaltic pump, although any suitable positive displacement pumping device may be used according to the invention.

The self-contained ink jet cartridge refurbishing system 200 described above has particular application in a retail ink jet cartridge refurbishing arrangement. Because system 200 utilizes cradle attachment arrangement 208 to quickly change ink jet cartridge cradles, the system can be specifically adapted to refurbish substantially any ink jet cartridge. The system can be employed in a retail arrangement in which a user brings their used cartridge to the retail refurbishing center, drops a cartridge off for refurbishment, and then later picks up the refurbished cartridge after the cartridge has been refurbished at the retail location. This is in contrast to prior ink jet cartridge refurbishing systems in which the cartridge had to be sent away to a central refurbishing facility. In another variation of the refurbishment arrangement, the user may trade in their used cartridge for a refurbished cartridge. An operator then uses the system 200 to refurbish the used cartridge and make it available to another customer dropping off a like cartridge.

In addition, the compact size of the invention and its application for refurbishing a variety of ink jet cartridges makes it suitable for use in an office environment. As soon as office employees use all of the ink in the cartridges of their ink jet devices, they may simply refill the cartridges using the present invention without incurring the expense of buying a new ink jet cartridge.

In any refurbishment application, office, retail, or production, certain additional equipment may be required to ensure the refurbished cartridge is in a usable state. For example, a testing unit such as Makro Micro Company, Croatia, Model CT8 or CT56 may be used to test each refurbished cartridge to ensure it is in proper working order prior to distribution to a customer or return to the user who dropped off the cartridge for refurbishment.

The above described preferred embodiments are intended to illustrate the principles of the invention, but not to limit the scope of the invention. Various other embodiments and modifications to these preferred embodiments may be made by those skilled in the art without departing from the scope of the invention.

The invention claimed is:

1. An ink jet cartridge refurbishing system including: (a) first vacuum source for operating air pressure driven components of the system; (b) a supporting surface; (c) a receiving feature secured to the supporting surface; and (d) an ink jet cartridge cradle having an attachment feature adapted to cooperate with the receiving feature to secure the ink jet cartridge cradle in an operating position with respect to the supporting surface and further including: (a) an ink fill tube; (b) a second vacuum source and a third vacuum source; (c) an ink jet cartridge clean and fill cradle having an ink fill sealing element connected to the ink fill tube, a maze vacuum sealing element connected to the second vacuum source, and a cartridge print head sealing element connected to the third vacuum source.

2. The ink jet cartridge refurbishing system of claim 1 wherein the ink jet cartridge clean and fill cradle includes a sliding component and a fixed component, the maze vacuum sealing element being positioned on the sliding component, the cartridge print head sealing element and the ink fill sealing element being positioned on the fixed component.

3. The ink jet cartridge refurbishing system of claim 2 wherein the maze vacuum sealing element includes a permeable, resilient surface which lines one side of the sliding component.

4. An ink jet cartridge refurbishing system including: (a) first vacuum source for operating air pressure driven components of the system; (b) a supporting surface; (c) a receiving feature secured to the supporting surface; and (d) an ink jet cartridge cradle having an attachment feature adapted to cooperate with the receiving feature to secure the ink jet cartridge cradle in an operating position with respect to the supporting surface and further including: (a) an ink pump assembly having an ink intake, an ink outlet, and a control input, the ink outlet being connected to a proximal end of an ink supply line; and (b) a fill gun having a fill needle, a handle connected to the fill needle, and a fill trigger switch provided on the handle, the fill needle being connected to receive fluid directed through the ink supply line, and the fill trigger switch being operatively connected to the control input so as to selectively apply a control signal to the control input.

5. The ink jet cartridge refurbishing system of claim 4 further including a skill switch located on the fill gun and operatively connected to the ink pump assembly, the kill switch being operable when activated to turn off the ink pump assembly.

6. The ink jet cartridge refurbishing system of claim 4 further including a timer, the timer being operatively connected to the ink pump assembly, the timer being operable to remove the control signal from the control input after a period of operation set by the timer.

7. The ink jet cartridge refurbishing system of claim 4 further including: (a) a housing having the ink pump assembly mounted in a interior thereof; and (b) a fill gun holster mounted on an exterior surface of the housing.

8. The ink jet cartridge refurbishing system of claim 7 wherein the fill gun holster includes a containment end adapted to collect excess ink flowing from the fill needle when the fill gun is in a holstered position.

9. The ink jet cartridge refurbishing system of claim 4 wherein the ink pump assembly includes a peristaltic pump.

10. A method of refurbishing an ink jet cartridge, the method including the steps of: (a) selecting an ink jet cartridge cradle to accept the ink jet cartridge; (b) attaching an attachment feature on the ink jet cartridge cradle to a receiving feature on a support surface; (c) inserting the ink jet cartridge into the ink jet cartridge cradle; and (d) applying a vacuum to an orifice of the ink jet cartridge through a vacuum sealing element mounted on the ink jet cartridge and further including the steps of: (a) inserting a fill needle of a fill gun into the ink jet cartridge; (b) activating a fill trigger switch on the fill gun to activate an ink pump assembly to transfer ink from an ink supply line to the fill needle and into the ink jet cartridge; and (c) deactivating the pump assembly.

* * * * *